United States Patent [19]

Detalle et al.

[11] 4,260,081

[45] Apr. 7, 1981

[54] SLIDE-VALVE OUTPUT REGULATING THROTTLE

[76] Inventors: Pol Detalle; Richard Detalle, both of 11, rue Edouard-Herriot, Villers-lès-Nancy, France

[21] Appl. No.: 931,524

[22] Filed: Aug. 7, 1978

[51] Int. Cl.[3] ..... B22D 41/08

[52] U.S. Cl. ..... 222/600; 222/503; 251/212

[58] Field of Search ..... 251/205, 212, 326; 138/45; 222/502, 503, 559, 561, 600, 598

[56] References Cited

U.S. PATENT DOCUMENTS

| | | | |
|---|---|---|---|
| 3,511,261 | 5/1970 | Bick et al. | 222/600 X |
| 3,618,925 | 11/1971 | Girolami | 222/600 X |
| 3,685,706 | 8/1972 | Fehling | 222/598 |
| 3,976,094 | 8/1976 | Jandrasi et al. | 251/212 X |

FOREIGN PATENT DOCUMENTS

| | | | |
|---|---|---|---|
| 2714933 | 10/1978 | Fed. Rep. of Germany | 251/212 |

*Primary Examiner*—David A. Scherbel
*Attorney, Agent, or Firm*—Fleit & Jacobson

[57] ABSTRACT

The slide-valve throttle of the invention is intended to continuously regulate the output of high-temperature molten products from metallurgical vessels, notably from the bottom of casting ladles of the type currently used in foundry, and also for occluding the tap-hole thereof. This throttle comprises essentially an assembly of two slide plates adapted to move towards and away from each other and towards and away from the tap-hole axis, and arranged for uncovering or occluding the tap-hole while preserving for the casting passage formed through the nozzle and the slide plates at least two orthogonal planes of symmetry.

22 Claims, 15 Drawing Figures

FIG. 7
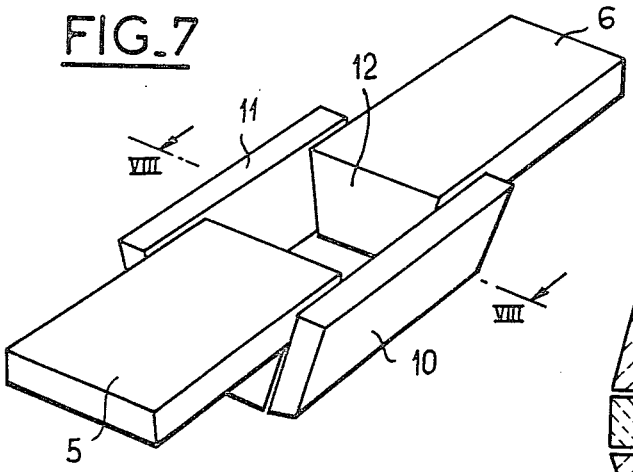
FIG. 8
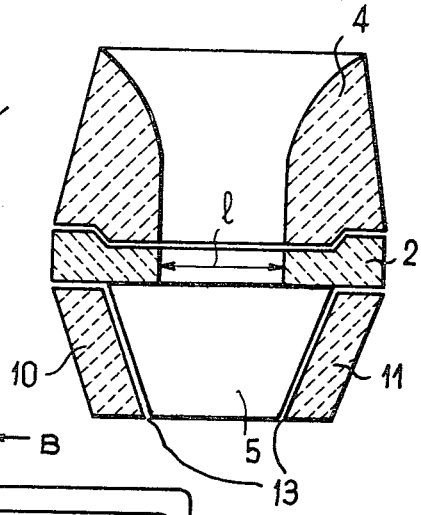
FIG. 9
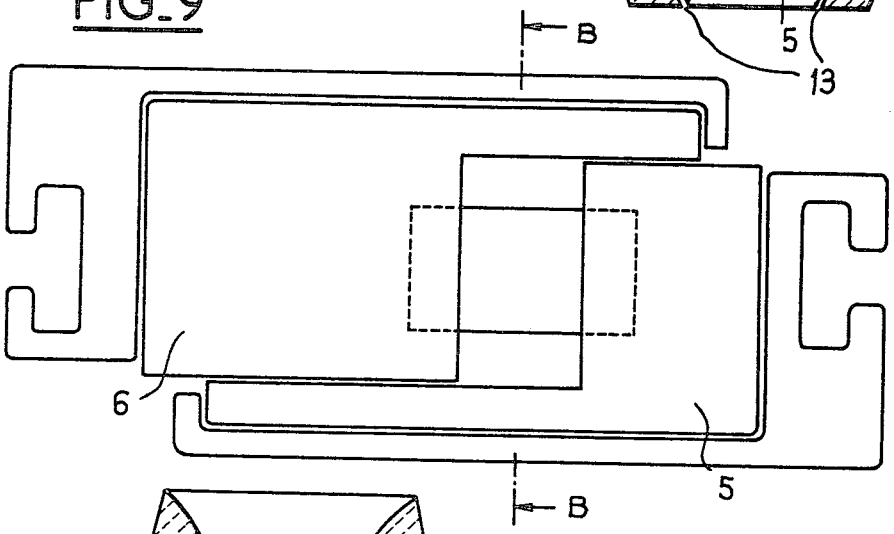
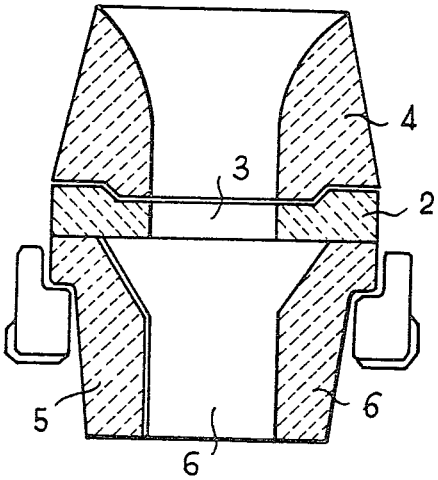
FIG. 10

1
2
3
4
5
6
13
14
15
16
17
18
19
20
21
22
23
24
25
32

SLIDE-VALVE OUTPUT REGULATING THROTTLE

This invention relates in general to throttling devices and has specific reference to a slide-valve output regulating throttle intended more particularly for controlling the tap hole output of casting ladles or vessels containing molten metal.

It is known to associate with the tap holes of casting ladles or like vessels, adapted to contain molten metal such as steel, slide valves wherein a movable ceramic plate formed with a through hole is adapted to slide in relation to, and against, a fixed plate provided with an orifice registering with the tap hole of the ladle or vessel.

The throttle is open when the through hole formed in the fixed plate is aligned with the throughf hole of the movable plate. In devices of this character, the holes of both plates have predetermined sizes.

Now, a basic problem for foundry operators is to be able to regulate the molten metal output at any time during the casting operation, and more particularly to keep this output at a constant value.

Now the metal output through the tap hole depends essentially on the cross sectional area of this hole and on the pressure exerted on the metal.

The pressure subordinate to the level of the metal contained in the vessel decreases during the casting operation and consequently endeavours have been made with a view to compensate this loss of pressure notably by increasing proportionally the cross-sectional area of the tap hole itself.

Various more or less satisfactory propositions have been made in this respect, for example:

controlling the cross-sectional area of the tap hole by modifying the relative positions of the refractory plates in order to alter the mutual alignment of the holes of the fixed and movable plates and thus more or less throttle the passage formed thereby.

Although this method affords a continuous regulation, experience teaches that it is objectionable on account of, interalia, a premature wear of the refractory plates and an appreciable impairment of the quality of the jet of the molten metal due to the breaking of its symmetry.

the use of refractory materials having predetermined rates of wear may in certain cases compensate the loss of ferrostatic pressure, but this method on the one hand has no flexibility due to the impossibility of controlling the output during the casting operation and on the other hand prevents any re-use of the quick-wearing refractory components.

another solution consists in providing several orifices having different diameters in the movable plate so that a gaged diaphragm action is obtained by bringing in succession holes of increasing diameters in alignment with the hole in the fixed plate. However, this solution is also objectionable in that it is intrinsically discontinuous and requires the construction of a complicated, cumbersome and expensive sub-structure.

It is the primary object of the present invention to avoid these inconveniences on the one hand by preserving for the jet of molten metal a fixed casting axis and a double symmetry of the metal flow, and on the other hand and preferably by separating the throttling function from the output regulating function.

With this object in view, the present invention provides a slide-valve throttle for the tap hole of a vessel adapted to contain high-temperature products, notably molten metals, this throttle being characterized in that it comprises two plates adapted to slide symmetrically in relation to each other so as to throttle more or less completely said tap hole while preserving for the casting passage consisting of said hole and of the relative spacing between the two plates at least two orthogonal planes of symmetry.

Preferably, in this construction, one of the sliding plates is adapted to cover completely the tap hole, so that the two plates can slide simultaneously in the same direction to enable one of them to close the tap hole completely.

According to a modified form of embodiment, an additional plate is provided for performing by itself said tap-hole closing function, and in this case this third plate is located upstream or downstream of the output regulating plates.

These specific arrangements and other modified versions thereof constituting typical embodiment of the present invention will now be described more in detail with reference to the accompanying drawings, given by way of example, not of limitation. In the drawings:

FIG. 7 is a perspective view showing an assembly comprising regulation plates and lateral plates;

FIG. 8 is a cross-sectional taken along the line VIII—VIII of FIG. 7.

FIG. 9 is a plane view from above showing a typical form of embodiment with interfitting plates;

FIG. 10 is a section taken along the line B—B of FIG. 9;

Figure 1:
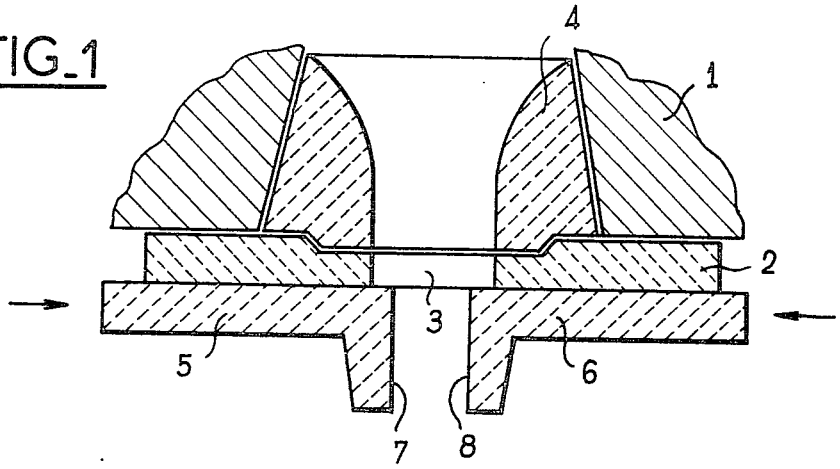
FIG. 1 is a diagrammatic longitudinal section showing a slide-valve throttle according to this invention.

Referring first to FIG. 1, a vessel 1 adapted to be filled with molten metal has fitted to its bottom a refractory plate 2 provided with a central orifice 3 overlying which is a refractory nozzle 4. Beneath the bottom is the output regulating device controlling the delivery of molten metal. This device comprises a pair of movable refractory plates 5, 6 adapted to slide against the lower face of the fixed plate 2 and disposed symmetrically in relation to the central hole of this fixed plate 2.

The pair of sliding plates 5, 6 have registering vertical faces 7 and 8, respectively, adapted to form a joint with each other in a plane coincident with the vertical diametral or median plane of the orifice 3. Thus, when the symmetric plates 5 and 6 are gradually and slidably moved away from each other, the orifice 3 is opened proportionally and symmetrically to its axis while preserving on the one hand the position of the jet axis and on the other hand the jet symmetry.

In actual practice, the two junction faces 7 and 8 of sliding plates 5 and 6 will soon or later undergo a certain erosion due to the passage of molten metal, so that closing the throttle completely may become impossible.

Figure 2:
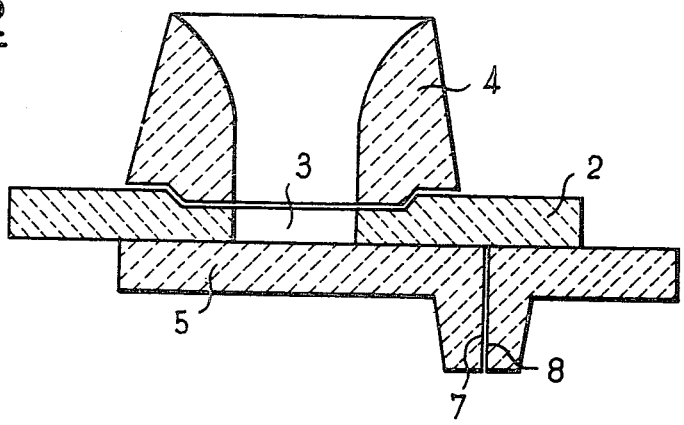
FIG. 2 is a diagrammatic section showing a throttle in which only one of the plates assumes the closing function.

However, this complete closing of the device may easily be obtained by so controlling the two plates 5 and 6 that they move simultaneously in the same direction. In fact, this movement will cause at least one of the plates 5 or 6 to close completely the orifice 3 of fixed plate 2, thus turning off the fluid flow as in the case of a conventional slide valve throttle (FIG. 2).

It will be seen that the closing movement takes place in the same alignment as the output regulating movement. On the other hand, the amplitude of the sliding movement which, if the orifice 3 has a maximum dimension D in the direction of the sliding movement, is equal to D/2 for the output regulation function, should be considerably greater for the total closing function.

In existing constructions of this type, an amplitude of about 2.5 D is currently used for circular orifices. According to the practical requirements to be met, one may use either a symmetrical assembly permitting a complete closing alternatively on one or the other of plates 5, 6, thus optimizing the use of the refractory materials from which these plates are made, however at the cost of a longer stroke and greater over-all dimensions, or an asymmetrical system permitting the total closing by means of only one of the sliding plates 5 or 6. In certain cases, it may be advantageous to further separate the closing function from the output regulating function by adding a complementary slide plate 9 provided with an orifice generally identical with the orifice of the fixed plate 2.

Figure 3:
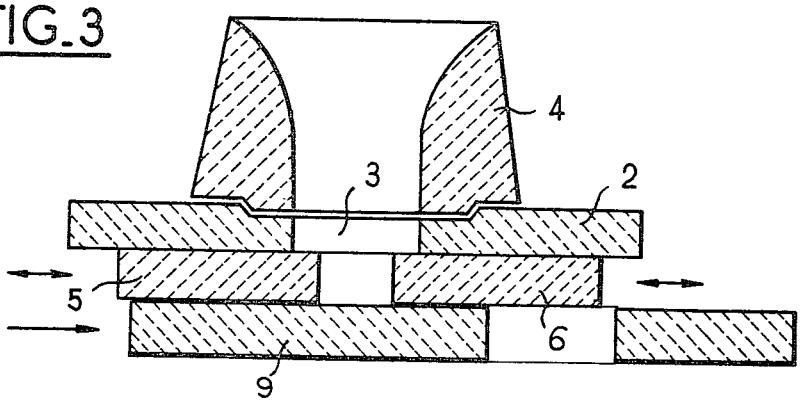
FIG. 3 is a diagrammatic section showing a throttle comprising a double plate system.

This additional closing plate 9 may be located downstream of the output regulation plates 5 and 6, as illustrated in FIG. 3. The set of refractory plates located upstream of this complementary plate 9, notably sliding plates 5 and 6, should fit very closely or tightly and join very accurately with each other at all portions thereof likely to contact the molten metal, in order to make the device perfectly tight.

Therefore, it is generally advantageous, in throttling devices of this character, to provide a sliding plate 9 upstream of plates 5 and 6, so that only one interface is caused to bear the total pressure exerted by the mass of molten metal while remaining perfectly tight.

Figure 4:
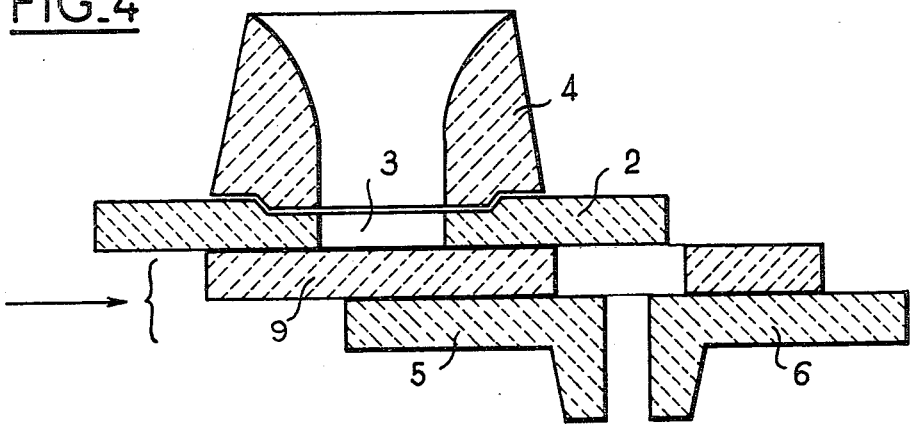
FIGS. 4 and 5 are sections similar to FIG. 3, with the additional plate disposed upstream and rigid or not with the output regulating plates.
Figure 5:
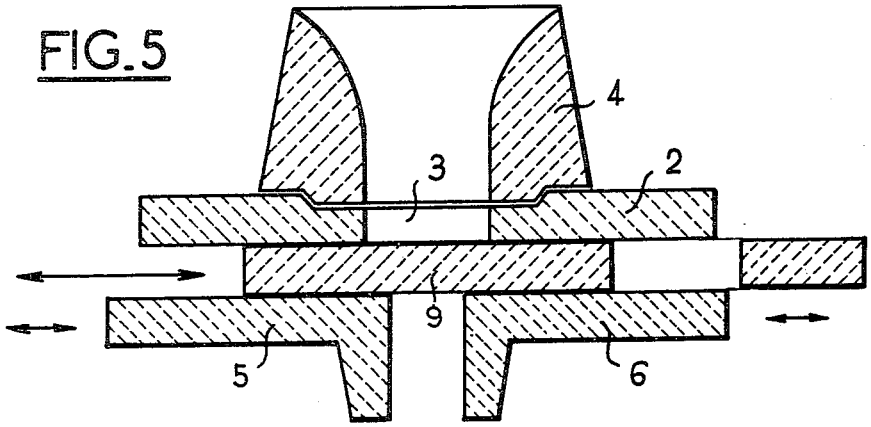

FIGS. 4 and 5 illustrate two modified forms of embodiment of the device according to this invention which differ from the preceding structures in that the output regulating slide plates 5 and 6 are either adapted to move bodily with the closing slide plate 9 (FIG. 4), or independent therefrom (FIG. 5).

The second arrangement constantly preserving the axis of the metal jet is apparently easier to construct, yet it is objectionable in that the same relatively high pressure is exerted in actual service against the interfaces between the fixed plate 2 and slide plate 9, on the one hand, and slide plates 5, 6 and 9, on the other hand, and furthermore this arrangement makes it difficult to recycle the plate 9 when plates 5 and 6 have to be replaced. It should be noted that in a device according to this invention the jet of molten metal throttled symmetrically in relation to a plane containing the axis of the tap hole, which in most instances and according to the current trend is plainly circular, assumes in its throttled condition a substantially rectangular configuration, which is rather advantageous.

In fact, both theory and experience teach that given a same output the metal flow tends to remain more lamellar in the case of a rectangular orifice than in the case of a circular orifice.

In order to obtain casting jets of which the cross-section is as close as possible to a square, it is advantageous, insofar as permitted by the present state of the modern technology of refractory manufacture, to make the fixed plate 2, the inner nozzle 4 and, if one is provided in the throttle device, the slide plate 9, with rectangular-sectioned orifices. Advantageously, the dimensions L and l of the above-mentioned orifices will be so chosen that they meet the requirement $L = l\sqrt{x}$, wherein x is the ratio of the maximum output to the minimum output contemplated.

With this formula it is possible to calculate the dimensions of the orifice departing as little as possible from the square configuration for the desired output ratio.

Figure 6:
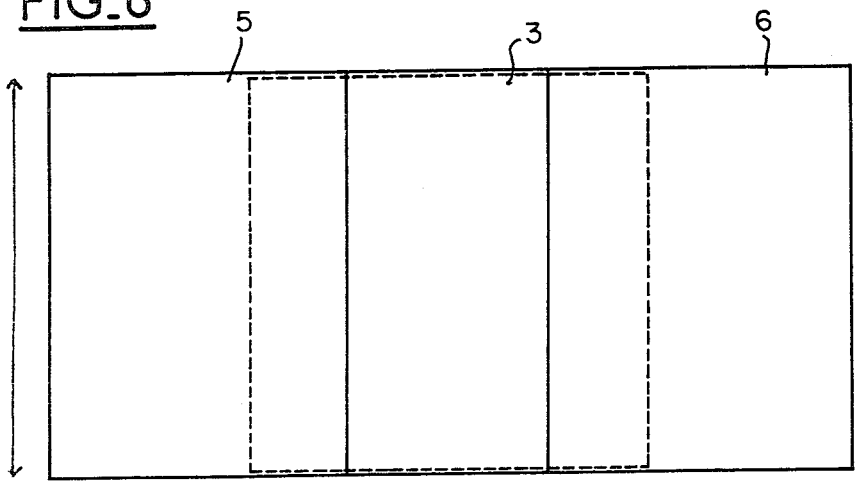
FIG. 6 is a diagrammatic illustration of the rectangular apertures formed by the regulation plates.

FIG. 6 illustrates a typical example of this calculation for a ratio $x=4$.

According to the present invention, certain means may be provided for guiding the jet laterally downstream of the fixed plate 2. In a specific form of embodiment of the invention, illustrated in FIGS. 7 and 8, refractory plates 10 and 11, independent of slide plates 5 and 6, are disposed laterally on either side of said last-mentioned plates 5 and 6 in order to protect the metal framework of the throttle and guide the jet of molten metal laterally. While a perfect fluid-tightness is necessary at the interface 12 between the slide plates 5 and 6, on the one hand, and the fixed plate 2, on the other hand, the interfaces 13 between the slide plates 5 and 6, on the one hand and the lateral guide plates 10 and 11, on the other hand, is not so important. In fact, these interfaces bear only the normal dynamic pressure exerted by the molten metal flowing through the channel and have no sealing function whatsoever. In general, rough-cast or rough-pressed elements are sufficient for the purpose, in contrast to the interfaces 12 which as a rule should be ground or otherwise finished by machining.

To prevent the tap hole 3 of fixed plate 2 from being superimposed to interfaces 13, it is advantageous that the relative spacing between slide plates 10 and 11 at the top thereof, be greater than the width l of tap hole 3.

Though not compulsory, it may be advantageous to so position plates 10 and 11 that the cross-sectional area of the throttle, at the bottom, be somewhat close to that of tap hole 3.

In the modified form of embodiment of the invention shown in FIGS. 9 and 10, the shapes of slide plates 5 and 6 are such that they imbricate with each other so that when they move in relation to each other the cross-sectional area of the orifice formed therebetween varies. The L-shaped interfitting shapes illustrated in FIG. 9 are also advantageous in that they facilitate a lateral tightening action.

Figure 11:
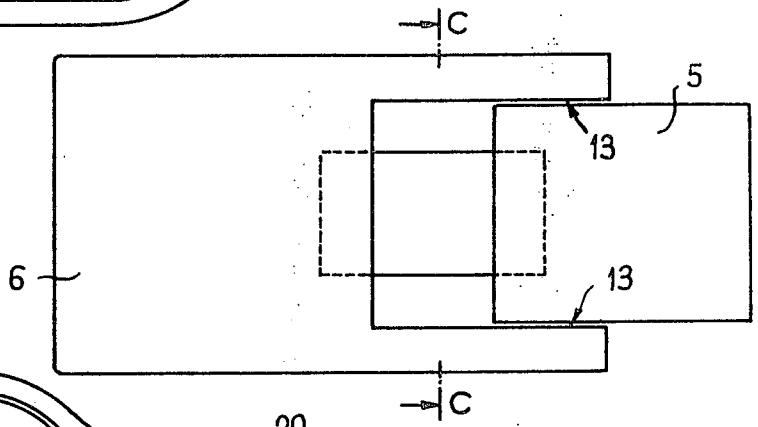
FIG. 11 is a modified embodiment of the structure shown in FIG. 9.
Figures 12, 13:
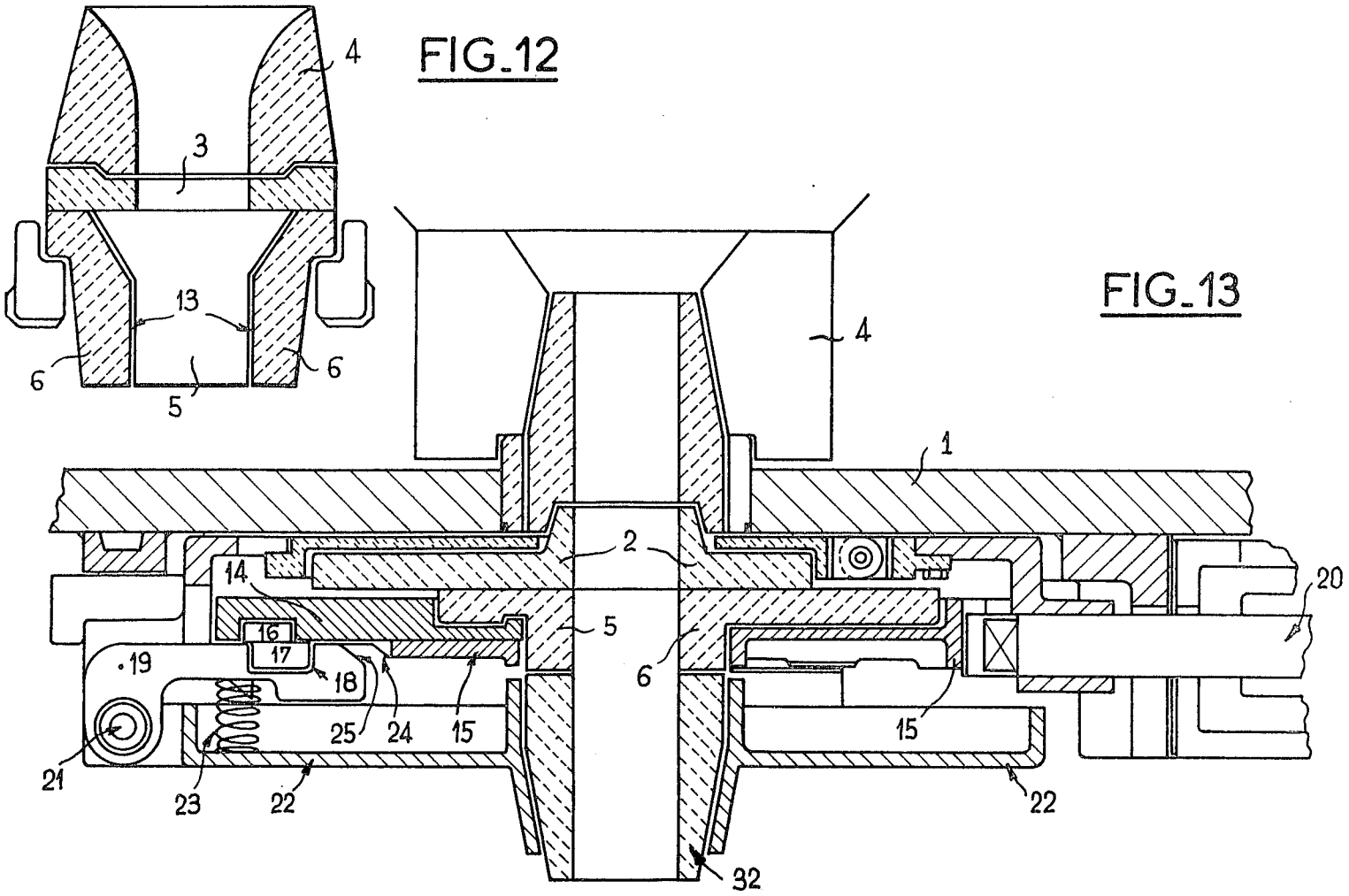
FIG. 12 is a section take along the line C—C of FIG. 11.
FIG. 13 is a longitudinal section showing a modified form of embodiment of a plate-type throttle incorporating control means.

FIGS. 11 and 12 illustrate another exemplary form of embodiment of the throttle device in which the plate 6 has a U-shaped end and the other plate 5 is shaped and dimensioned to penetrate the cavity formed between the two arms of plate 6. The movement of plates 5 and 6 in opposite directions is obtained by means of a single linear control mechanism illustrated at 20 in FIG. 13 in a practical application thereof to the driving of a throttle of the type shown in FIG. 11.

In this arrangement, the movements of plates 5 and 6 are obtained by means of slides 14 and 15 rigidly coupled thereto, respectively.

Figure 14:
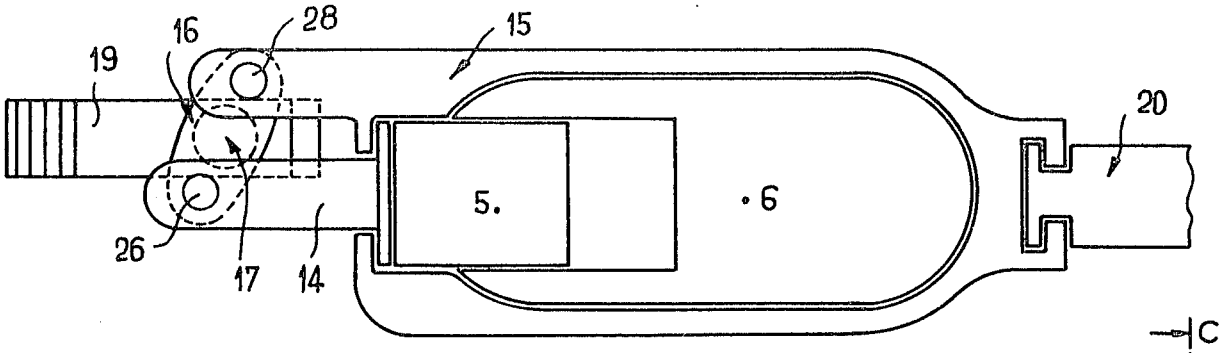
FIG. 14 is a schematic view from above corresponding to FIG. 13.

The slide plate 6 retained in slide 15 is urged tightly against the fixed plate 2 by means of a cover 22. Slide 14 is movable in slide 15 and both are operatively interconnected via a link 16 mounted on a pivot member 17 as illustrated in FIG. 14. Independent clamping means (not shown) engage directly the slide 15 or the slideways of slide 14 so as to control the bearing force exerted by slide plate 6 against the fixe plate 2. This result may be obtained by using dynamometric tightening means, spring means or any other suitable means known in the art. Referring now to FIG. 14, it will be seen that as already mentioned hereinabove the slides 14 and 15 are interconnected by a link 16 disposed substantially symmetrically in relation to its central pivot member 17. During the operation of the device as an output regulator, the pivot member 17 of link 16 is in a fixed position in a bearing-forming cavity 18 formed in a retractable cam 19. This cam 19, adapted for example to pivot about the hinge pin 21 of cover 22, is constantly urged to its operative position by a spring 23 or any other suitable return means.

Figure 15:
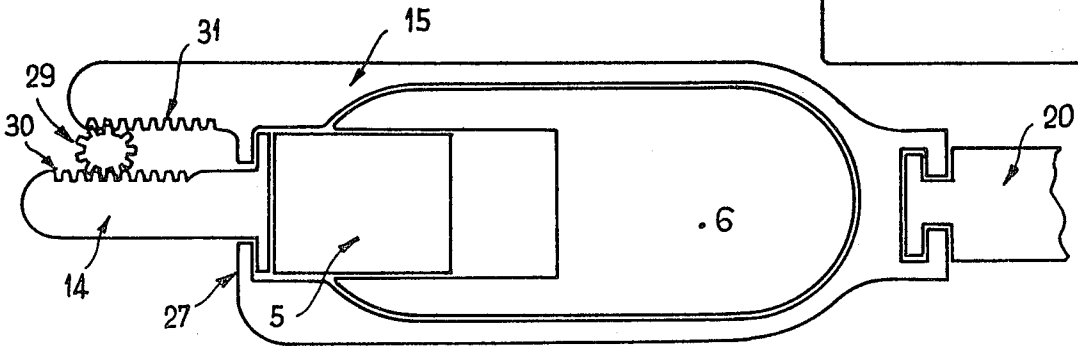
FIG. 15 is a modified embodiment of the structure shown in FIG. 14.

During the throttle actuation, the plates are driven in the same direction, the pivot member 16 is retracted from its cavity 18 and a thrust exerted on control member 20 will drive both slides 14, 15 and link 16 simultaneously. If the throttle in its closed position is opened by pulling the control member or rod 20 and consequently the slide 15, the link 16 being free and the slide plate 1 subjected to considerable frictional forces due to its contact with the fixed plate 4, slide 14 will move back as far as possible in relation to slide 15. A stop 27 (FIG. 15) is advantageously provided for controlling the maximal backward movement of slide 14 and presetting the maximal relative spacing of slide plates 5 and 6. Another stop member is provided on the cover 22, so that for example in the fully open position the axis of tap hole 3 will be coincident with the axis of the orifice formed between said slide plates 5 and 6. Thus, when the throttle is moved from the closed position to the fully open position, the pivot member 17 will slide on cam 19 until it registers with its bearing-forming cavity 18.

Then the spring or like return means 23 urges the cam 19 to lock the pivot member 17 in position, and the throttle can operate as an output regulator. In fact, operating the slide 15 in the closing direction will cause through the link 16 a symmetrical but opposite movement of slide 14. Beyond a predetermined stroke corresponding to the desired cross-sectional area for the tap orifice, cam 19 is retracted, for example under the control of a contra-cam 24 formed on slide 15 and bearing at 25 against said cam 19. The geometrical configurations of said contra-cam 24 and bearing or cam surface 25 is such as to produce the dead stroke of the actuator which is necessary for releasing the pivot member 17 from its cavity 18.

When the pivot member 17 is thus freed, it is possible to shut the throttle, the control action driving the slides 14, 15 and link 16 in the same direction.

It will be readily understood that the link 16 should be so designed as to operate in a push-pull manner so that the slide plates 5 and 6 can be moved towards and away from each other, at will. The pivoted couplings 26 and 28 between the link 16 and slides 14 and 15, respectively, are symmetrical in relation to the pivot member 17 and, when the throttle operates as an output regulator, they describe circular paths with respect to link 16 and straight paths with respect to slides 14 and 15. Though these paths are close to each other, some means must be provided, as a rule, for taking up the difference therebetween, for example by providing sufficient lost motion or forming a flat face on each fitting of the slides corresponding to the couplings 26 and 28 of link 16. According to another modified version of the invention shown in FIG. 15, the mechanism producing the relative movements of slides 14 and 15 comprises a toothed pinion 29 meshing with racks 30 and 31 formed on slides 14 and 15, respectively.

For operating the device as an output regulator, the position of the shaft of pinion 29 is locked by means of a cam mechanism similar to the one described hereinabove. This is attended by opposed symmetrical movements of slides 14 and 15. The throttle operation is obtained by releasing the shaft of pinion 29 as explained in the foregoing.

In the arrangement illustrated in FIG. 13, a fixed nozzle 32 is rigid, or formed integrally with, cover 22 and advantageously closely contiguous to slide plates 5 and 6 to prevent any seeping of liquid metal at this joint.

It is clear that, except for the joint between slide plates 5 and 6, which must remain perfectly fluid tight notwithstanding the static and dynamic fluid pressure, the joints located downstream thereto, namely the lateral joints between these slide plates 5, 6 and the lower joints between these slide plates and the fixed nozzle 32, are theoretically free of any static or dynamic pressure from the fluid.

However, it may be advantageous to counteract any undesired leakage of fluid by blowing gas either through porous refractory elements located upstream of the joints or through the joints themselves.

What is claimed as new is:

1. Slide valve throttle for controlling flow of high temperature product, notably molten metal, through a tap hole formed in a bottom side of a vessel, said slide valve throttle comprising:

two regulating slide plates having confronting surfaces defining an opening aligned with an axis of said tap hole of said vessel, the plates being mounted on the vessel for coplanar sliding movement towards and aways from each other to regulate the size of the opening while maintaining for the tap hole two orthogonal planes of symmetry; and closure means movable into a closure position for positioning a continuous face to prevent flow of product through the tap hole.

2. Slide valve throttle according to claim 1, wherein the two plates are displaceable together simultaneously in one direction so that an upper face of one of the plates is the continuous face preventing flow of product through the tap hole.

3. Slide valve throttle according to claim 1, wherein said closure means comprises a relatively fixed plate disposed continuously to the bottom of the vessel, said relatively fixed plates having a hole alignable with the tap hole, and at least a part of said relatively fixed plate being adapted to slide so that a continuous face of the fixed plate shuts the tap hole.

4. A slide valve throttle according to claim 1, wherein said closure means comprises a slidable closing plate located upstream of said two regulating slide plates.

5. A slide valve throttle according to claim 4, wherein said two regulating slide plates move bodily with said closing plate.

6. A slide valve throttle according to claim 1, wherein said closure means comprises a slidable closing plate located downstream of said two regulating slide plates.

7. A slide valve throttle according to claim 1, wherein the tap hole has a rectangular cross-sectional shape.

8. A slide valve throttle according to claim 1, wherein lateral refractory plates are provided detachable for guiding and protecting a jet of high-temperature product flowing through said tap hole.

9. A slide valve throttle according to claim 1, wherein the slide plates are so designed that they fit into each other and free only the tap hole.

10. A slide valve throttle according to claim 1, wherein the slide plates are L-shaped.

11. A slide valve throttle according to claim 1, wherein a lateral clamping force is exerted on the slide plates.

12. A slide valve throttle according to claim 1, wherein one of the slide plates is U-shaped and the other slide plate has a slide fit between two arms of the U.

13. A slide valve throttle according to claim 1, wherein the tap hole upstream of the slide plates has a cross-sectional configuration differing from that formed between interfitting joints of said plates.

14. A slide valve throttle according to claim 1, wherein a single control system is provided for controlling an output regulating function and a closing function of said slide valve throttle.

15. A slide valve throttle according to claim 14, wherein said slides are interconnected by a toothed pinion in constant meshing engagement with a pair of opposite racks formed in each slide, respectively.

16. A slide plate throttle according to claim 15, wherein a cam having return means is provided for locking a pivot member of said toothed pinion when said throttle is in its fully open position.

17. A slide valve throttle according to claim 14, wherein end positions of said slides are predetermined by providing suitable stop members for setting the position of the center of a casting jet, and the minimal and maximal relative spacing of the plates.

18. A slide valve throttle according to claim 1, wherein each slide plate is carried by a slide, one slide having a slide fit in the other slide.

19. A slide valve according to claim 18, wherein the slides are interconnected by a link having a central pivot member and two coupling means disposed symmetrically in relation to said pivot member for each slide, respectively.

20. A slide valve throttle according to claim 19, wherein a cam having return means is provided for locking the pivot member of said link when said throttle is in a fully open position.

21. A slide valve throttle according to claim 20, wherein said cam is retractable by means of a contra-cam formed in one of said slides, when the cross-sectional area of the casting orifice is reduced in a predetermined ratio.

22. A slide valve throttle according to claim 1, further comprising a fixed plate and means for clamping the slide plates against the fixed plate.

* * * * *